United States Patent [19]

Fukami et al.

[11] Patent Number: 4,500,479

[45] Date of Patent: Feb. 19, 1985

[54] HUMIDIFIER

[75] Inventors: Akira Fukami, Okazaki; Hiroki Noguchi, Oobu; Hiroshi Hamaguchi, Aichi, all of Japan

[73] Assignee: Nippon Soken, Inc., Nishio, Japan

[21] Appl. No.: 404,488

[22] Filed: Aug. 2, 1982

[30] Foreign Application Priority Data

Sep. 9, 1981 [JP] Japan ..... 56-142008

[51] Int. Cl.[3] ..... B01F 3/04

[52] U.S. Cl. ..... 261/98; 98/2.11; 261/99; 261/DIG. 4

[58] Field of Search ..... 261/99, 104, 106, 98, 261/DIG. 4, DIG. 15, DIG. 72; 55/DIG. 30; 98/2.11; 62/310, 314, 315; 422/122–124

[56] References Cited

U.S. PATENT DOCUMENTS

| | | | |
|---|---|---|---|
| 2,146,071 | 2/1939 | Horvath | 261/DIG. 72 |
| 2,156,879 | 5/1939 | Slater | 261/106 |
| 2,453,018 | 11/1948 | Kercheval | 98/2.11 X |
| 2,796,014 | 6/1957 | Montgomery et al. | 261/DIG. 4 |
| 2,970,456 | 2/1961 | Rice | 261/DIG. 4 |
| 3,278,175 | 10/1966 | Hirtz | 261/99 |
| 3,738,621 | 6/1973 | Anderson | 261/DIG. 4 |
| 3,855,371 | 12/1974 | Morrow et al. | 261/DIG. 15 |
| 4,251,239 | 2/1981 | Clyde et al. | 261/DIG. 72 |
| 4,364,760 | 12/1982 | Higuchi et al. | 55/DIG. 30 |
| 4,401,013 | 8/1983 | Ohashi et al. | 261/DIG. 4 |

*Primary Examiner*—Richard L. Chiesa

*Attorney, Agent, or Firm*—Cushman, Darby & Cushman

[57] ABSTRACT

An air humidifier having a humidifier element provided with an air passage constructed by a water-absorbable material. The air is humidified as it flows through the air passage in the humidifier element.

4 Claims, 4 Drawing Figures

HUMIDIFIER

BACKGROUND OF THE INVENTION

The present invention relates to a humidifier suitable for use in automotive air conditioning.

Hitherto, various inventions have been achieved in connection with humidifiers and some of them have been carried out commercially. One of these known humidifiers has a water tank and an electric heater or a burner for heating the water in the tank thereby to produce steam. This type of humidifier will be referred to as "water tank type humidifier", hereinafter. Another known humidifier is adapted to directly inject steam of high temperature and pressure into air. This type of humidifier will be referred to as "steam type humidifier", hereinafter. Still another known humidifier employs an ultrasonic vibrator adapted to generate fine particles of water. This type of humidifier will be referred to as "ultrasonic humidifier", hereinafter. A further known humidifier incorporates a heat exchanger for heating air, onto which water is sprayed or dripped to become steam. This type of humidifier will be referred to as "spray type humidifier", hereinunder. Thus, various types of humidifiers have been produced and sold commercially.

Among these known humidifiers, the water tank type humidifier is not suitable for use on automobiles because it cannot operate stably due to the vibration during running of the automobile and because it requires a heat source of a large capacity. The steam type humidifier also is not suitable because it necessitates separate steam generating equipment such as a boiler. Clearly, these two types of known humidifiers are unsuitable for use on automobiles. The ultrasonic humidifier is also unsuitable because it produces mist-like steam to excessively wet the compartment and passengers and to restrict the sight of the driver. In addition, it is necessary to use an oscillation circuit which is generally expensive.

The spray type humidifier is free from the problems stated above. In addition, the known warm water type heater used in automotive air conditioning can be used advantageously as the heat exchanger. In this case, however, air has to be heated simultaneously with the humidification. Thus, this type of humidifier can suitably be used only when the air is humidified in the heating mode, but cannot apply to the case where the air has to be cooled down simultaneously with the humidification.

SUMMARY OF THE INVENTION

As has been described, the known humidifiers have their peculiar disadvantages.

Accordingly, it is a primary object of this invention to provide a humidifier which can be produced easily at a low cost and which is entirely free from the above-described problems of the prior art.

More particularly, the invention aims at providing a humidifier having a humidifier element having an air passage constructed with a water absorbing material. In operation, air is made to pass through the wetted air passage of the humidifier so that the air is humidified moderately. This humidifier has a simple construction and is less expensive as compared with known humidifiers. Moreover, this humidifier does not necessitate any specific heat source. Therefore, when incorporated in automotive air conditioning, this humidifier reduces the cooling load and provides a good feel of cooling, while effectively cleaning the air.

DESCRIPTION OF THE PREFERRED EMBODIMENTS

Hereinunder, the invention will be fully explained through specific embodiments applied to an automotive air conditioner.

Figure 1:
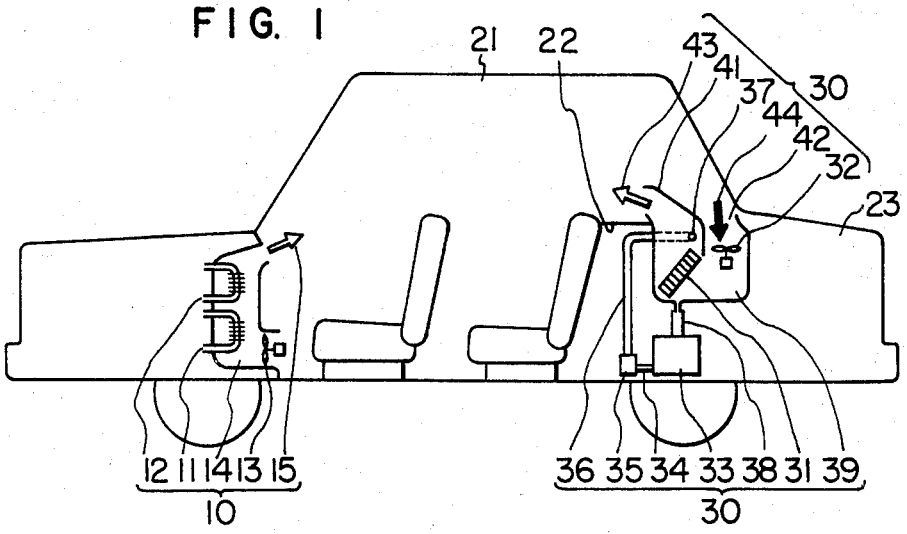
FIG. 1 is a longitudinal sectional view of an automobile schematically showing a humidifier 30 of this invention mounted therein.

FIG. 1 is a longitudinal sectional view of an automobile having a passenger compartment 22 and a humidifier 30 in accordance with an embodiment of this invention. A reference numeral 10 designates an automotive air conditioner known per se having an evaporator 11, heater 12, blower 13, duct 14 and, although not shown, a compressor, condenser, and dampers for switching the air passage. The humidifier 30 of the invention is installed in the trunk room 23 of the automobile, and is provided with a duct 39 which has an air inlet opening 42 from the passenger compartment 22 and an air outlet opening 41 to the compartment in a rear partition 22. A blower 32 driven by an electric motor, a humidifier element 31 and a pipe-like nozzle 37 are disposed in the duct 39. The humidifier 30 further has a water tank 33, punp 36 and water pipes 34, 36 and 38.

Figure 2:
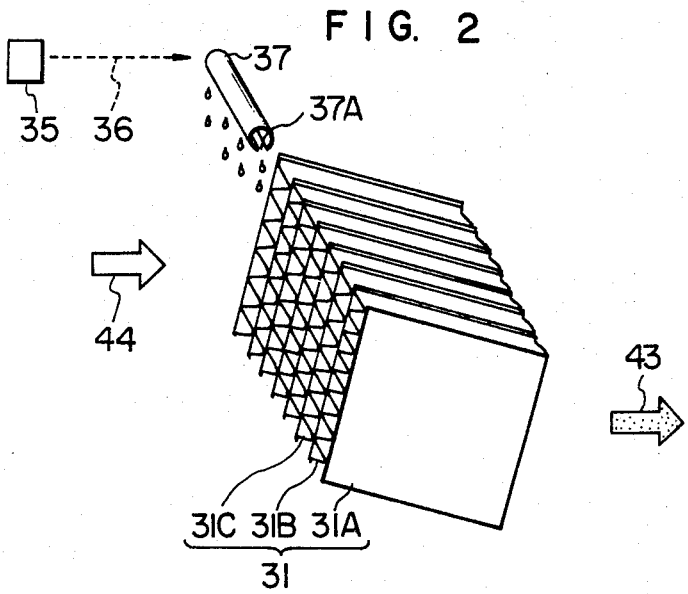
FIG. 2 is a perspective view of the humidifier element 31 shown in FIG. 1 having a laminated structure consisting of layers of flat sheet and corrugated sheet.

Referring now to FIG. 2, the humidifier element 31 has a laminated structure consisting of flat sheets 31A and corrugated sheets 31B arranged alternatingly in layers. The flat sheets and corrugated sheets are made of material having high water absorbability such as Japanese paper. In consequence, air passages 31C are formed between the flat sheets 31A and corrugated sheets 31B. The nozzle 37 has a plurality of small apertures 37A arranged in a row parallel to the longitudinal axis thereof.

In operation, the air 44 sucked through the inlet opening 42 reaches the humidifier element 31 through the duct 39. On the other hand, the water sucked from the water tank 33 by the pump 35 through the water pipe 34 is delivered to the nozzle 37 through the water pipe 36 and is sprayed or dripped through the apertures 37A. The sprayed or dripped water is trapped by the humidifier element 31 so as to wet the flat sheets 31A and corrugated sheet 31B which are made of Japanese paper. The water is then spread over the entire areas of the sheets 31A, 31B due to the capillary action. As the air flows through the air passages 31C, the air makes contact with the sheets 31A, 31B over wide areas of the latter so that the water is evaporated to humidify the air. The air thus humidified is discharged into the compartment 21 through the air outlet 41 as a stream 43 of humidified air. The surplus water drips into a drain pan formed by the bottom of the duct 39 and returned to the water tank 33 through a drain pipe 38.

As will be understood from the foregoing description, the present invention makes an effective use of the advantage of the humidifier element 31, i.e. a large contact area of evaporation area.

In some cases, it is required to humidify the air while chilling the same. This could not be accomplished with the known spray heater type humidifier. In the known automotive air conditioner 10, air is heated by the warm water type heater 12 in the winter season. In such a case, it is preferred to humidify the air simultaneously with the heating. This can be achieved by the humidifier 30 of the invention, as well as by the known spray type humidifier.

On the other hand, in the summer season, the air is cooled by operating the refrigeration cycle including the evaporator 11. In order to obtain a good feel of the so conditioned air, the temperature of the chilled air 15 at the outlet is adjusted to range between 5° C. and 10° C. The setting of air outlet temperature at such a low level excessively dries the air in the compartment 21 because of the large dehumidificating effect of the air conditioner 10. If the humidification is made by a spray type humidifier, the air is undesirably heated simultaneously with the humidification, so that hot humidified air is blown out of the outlet impart an unpleasant feel. Moreover, the cooling load of the refrigeration unit of the air conditioner 10 is increased by the introduction of the heated air.

This problem, however, can be overcome perfectly by the use of the humidifier 30 in accordance with the invention. Namely, the humidifier of the invention does not necessitate any specific heat source. Thus, the humidified air blown out of the outlet 41 has been chilled because the latent heat is removed during the evaporation of the water. Thus, the humidified air has a temperature which is about 5° to 8° C. lower than ambient air temperature. Therefore, the feel of cooled air is improved and the cooling load imposed on the refrigeration unit of the air conditioner 10 is decreased considerably. Furthermore, the humidifier 30 of the invention functions as a kind of an aqueous filter, i.e. an air cleaner, by removing cigarette smoke or the like suspended by the air.

An experimental humidifier element 31 was fabricated to have a length of 100 mm, breadth of 40 mm and a thickness of 200 mm. The thickness of one layer was 2 mm and the pitch of the corrugations was 4 mm. This humidifier element exhibited a humidification power of 500 cc/hour. This capacity is quite adequate for household use or for automotive air conditioning. This humidification element exhibited a flow resistance which is as small as 1.5 mm $H_2O$ at the flow rate of 100 $m^3$/hour.

Although the operation and effect of the humidifier of the invention has been described through a specific embodiment, the described embodiment is not exclusive and various changes and modifications may be imparted thereto.

For instance, the humidifier 30 can be installed at any suitable place although it is mounted in the trunk room 23 in the described embodiment. It is also possible to use any material highly capable of absorbing water as the material of the flat sheet 31A and corrugated sheet 31B in place of the Japanese paper in the described embodiment. For instance, it is possible to use other kinds of paper or porous ceramic material.

Figure 3:
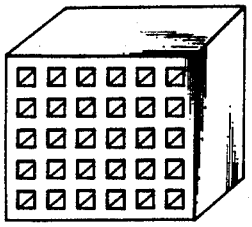
FIG. 3 is a perspective view of a humidifier element made of a porous ceramic material.
Figure 4:
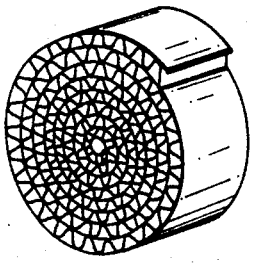
FIG. 4 is a perspective view of a humidifier element formed by winding flat sheet and corrugated sheet in layers.

FIG. 3 shows a honeycomb-like humidification element which is shaped in one body by an extrusion from a water-absorbable porous ceramic material. It is also possible to use a paper containing activated carbon fibers and cellulose fibers mixed therewith during pulping. In this case, the air cleaning effect is enhanced advantageously thanks to the adsorption effect offered by the active carbon fibers. Although the humidifier element shown in FIG. 2 has a substantially cubic form, this is not exclusive and the element can have a parallelopiped shape as shown in FIG. 1 or other suitable form. For instance, the humidification element can have the form of a rolled honeycomb structure produced by rolling a laminated structure consisting of a flat sheet and a corrugated sheet as shown in FIG. 4. In order to decrease the required driving power of the blower 32, it is preferred to diminish the pressure drop of air across the humidifier element as much as possible. It is not always necessary to use a specific water tank 33 for wetting the humidifier element. Namely, the water may be derived from a source such as a drain pan which collects the drain condensed on the surface of the evaporator.

The pump 35 can be omitted if the water tank 35 is disposed at a level higher than the level of the nozzle 37 to permit the continuous water supply by the force of gravity. The surplus water may be discharged to the outside instead of being returned to the water tank 33 through the drain pipe 38. Although in the described embodiment the nozzle 37 has a pipe-like form, other types of nozzles can be used provided that they can supply the humidifier element with water.

It is possible to arrange such that the pump 35 is automatically controlled in accordance with a signal from a humidity sensor placed at a suitable place in the compartment 21 to sense the humidity in the latter. By so doing, the moisture of air in the compartment can be controlled automatically to provide a more comfortable feel.

Although the foregoing description has been made mainly with reference to an automotive air conditioner, it will be clear to those skilled in the art that the humidifier to the invention is applicable to other uses such as household air humidifiers or the like.

What is claimed is:

1. An automobile humidifier mounted behind the passenger compartment of an automobile provided with conventional air conditioning means having air heating and cooling functions, said humidifier comprising:

an air duct mounted behind the passenger compartment of an automobile and having an air inlet and an air outlet from and to, respectively, the compartment;

a humidifier element in said duct having air passages therethrough, the walls of which are constructed of high water absorbing material, said passages being adapted to be inclined downward, said element having a laminated structure comprising alternating non-corrugated sheet material and corrugated spacer sheet material of highly water absorbable paper containing activated carbon fibers;

a blower disposed in said duct for blowing air through said passages;

nozzle means for applying water into the upper ends of said passages; and means for supplying said nozzle means with water.

2. An automobile humidifier according to claim 1 wherein the structure is of rolled layer configuration.

3. A automobile humidifier according to claim 1 wherein the non-corrugated sheets are flat and substantially parallel.

4. A humidifier according to claim 1, wherein said water-absorbable material is a porous ceramic material and said humidifier element is produced by an extrusion from said porous ceramic material to have an integral honeycomb-form.

* * * * *